US006203228B1

(12) United States Patent
Schweizer

(10) Patent No.: US 6,203,228 B1
(45) Date of Patent: Mar. 20, 2001

(54) WRITING IMPLEMENT

(75) Inventor: Manfred Schweizer, Eckental (DE)

(73) Assignee: Schwan-Stabilo Schwanhausser GmbH & Co., Heroldsberg (DE)

( * ) Notice: Subject to any disclaimer, the term of this patent is extended or adjusted under 35 U.S.C. 154(b) by 0 days.

(21) Appl. No.: 09/611,500

(22) Filed: Jul. 7, 2000

(30) Foreign Application Priority Data

Jul. 30, 1999 (DE) ..... 299 13 378

(51) Int. Cl.[7] ..... B43K 7/08
(52) U.S. Cl. ..... 401/142; 401/222
(58) Field of Search ..... 401/143, 141, 401/142, 222, 217, 223

(56) References Cited

U.S. PATENT DOCUMENTS 2,777,422 * 1/1957 Cofield, Jr. et al. ..... 401/142
4,889,442 * 12/1989 Takagi et al. ..... 401/142
5,655,847 * 8/1997 Kobayashi et al. ..... 401/219
6,012,864 * 1/2000 Asami ..... 401/142
6,132,124 * 10/2000 Ogura et al. ..... 401/142

FOREIGN PATENT DOCUMENTS 4443187 6/1995 (DE) .
3-0019897 1/1991 (JP) .
11-0020371 1/1999 (JP) .

* cited by examiner

*Primary Examiner*—David J. Walczak
(74) *Attorney, Agent, or Firm*—Bachman & LaPointe, P.C.

(57) ABSTRACT

A writing implement comprising a dispensing device for writing liquid at the front end of the implement and a liquid reservoir for holding the writing liquid which is at least partly transparent at the rear end of the instrument, the improvement comprising the liquid reservoir is coated on the inside surface, at least in part, with a silicone rubber layer which allows the writing liquid to run off the inside surface.

7 Claims, 1 Drawing Sheet

WRITING IMPLEMENT

BACKGROUND OF THE INVENTION

The invention relates to a writing implement having a dispensing device for writing liquid at the front end and a liquid reservoir at the rear end.

Writing implements operated with liquid ink or liquid color solution, such as, for example, writing, painting, drawing or marking implements, usually consist of a liquid reservoir for accommodating the ink or dye solution and an ink dispensing device via which the ink is dispensed little by little during writing. Consumers like pens in which the ink stock is visible. These are known as "free ink systems". In order to be able to see the amount of ink still available, at least part of the liquid reservoir in writing implements of this type consists of a transparent plastic. If particularly high requirements are made of transparency, polyester, polyamide or polystyrene are possible materials. However, owing to the excellent mechanical properties, transparent grades of polyolefins, in particular polypropylene, are increasingly also being used. Polypropylene is hydrophobic and repels hydrophilic liquids. If, therefore, use is made of a water-based ink, which generally has relatively high surface tension, an ink film forming on the walls of the reservoir tears open at least partly, so that the fill level is readily visible. If, however, use is made of writing liquids whose surface tension is low, for example solvent-based inks or water-based writing liquids containing emulsifiers, a film remains adhering to the walls of the liquid reservoir and does not allow the fill level to be seen at all or only with difficulty or after an extended time. This problem is particularly serious if an ink based on a lipophilic solvent is used in combination with a lipophilic plastic.

In order to solve this problem, it has already been proposed to coat the inside of a liquid reservoir with suitable hydrocarbons. However, this method is most suitable if emulsifier-free, water-based inks are used. It is unsuitable for solvent-based writing liquids as the hydrocarbon coating partly or completely dissolves. The coating is thus removed, and under certain circumstances the writing liquid is changed. Both are undesired.

Accordingly, it is a principle object of the invention to provide a writing implement in which the fill level of the writing liquid can be seen easily and rapidly. It is a further object of the invention to provide a coating for a liquid reservoir which allows a liquid film adhering to the surface rapidly runs off the inside surface. In accordance with the invention the coating must exert its action durably and must not change the writing liquid in a disadvantageous manner.

SUMMARY OF THE INVENTION

The foregoing objects are achieved by providing a writing implement having a dispensing device for writing liquid at the front end and a liquid reservoir which can be looked into at least partly at the rear end, wherein the reservoir is lined on the inside, at least partly, with a silicone rubber layer.

It has been found that on use of a crosslinked silicone rubber which is applied in a thin layer to the inner wall of the liquid reservoir, dye liquid or ink liquid runs off the wall of the liquid container rapidly. In this way, the available writing liquid stock is readily visible at all times.

DETAILED DESCRIPTION

Figure 1:
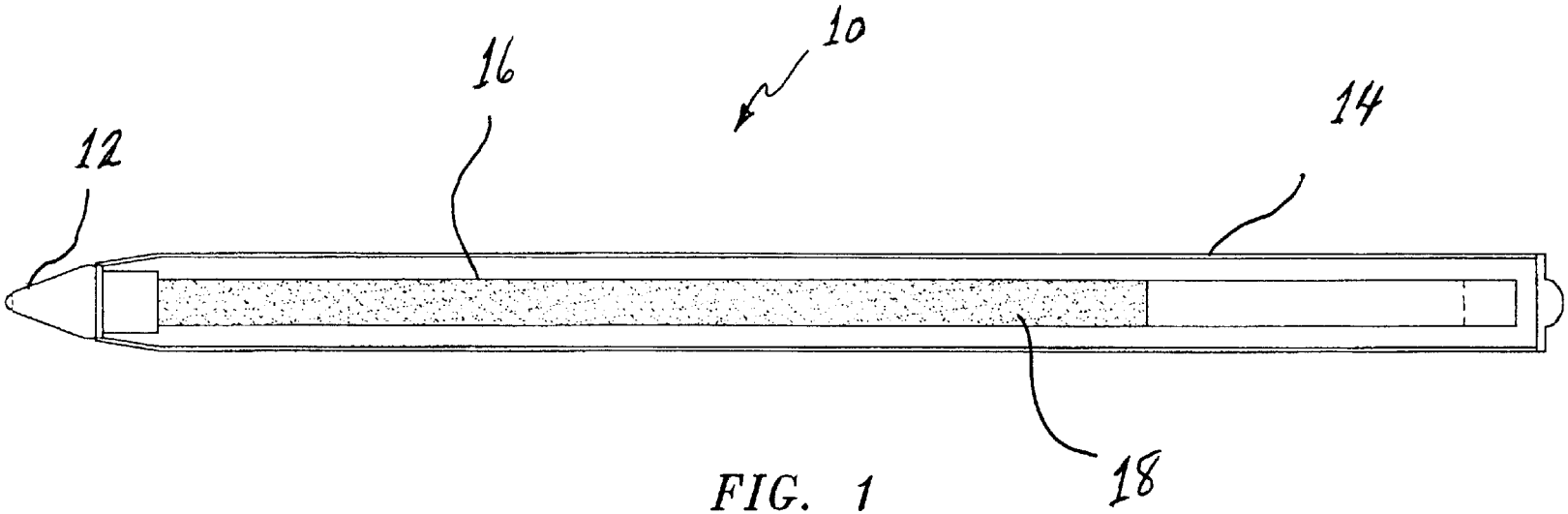
FIG. 1 is a sectional side view of a writing implement illustrating a liquid reservoir in accordance with the present invention.

In accordance with the invention, a writing implement 10 is provided (see FIG. 1) whose front part has a writing liquid dispensing device 12 which is designed in a manner known per se for dispensing ink during writing. The rear part 14 of the writing implement is formed by a liquid reservoir 16 for accommodating the writing liquid 18. The reservoir is at least partly transparent. It can be opaque, for example in the region of the grip zone, and can in addition be provided in a conventional manner with a print, so that it cannot be looked into from all angles. In general, the liquid reservoir consists of a plastic, the use of polypropylene being preferred. In accordance with the invention, the writing implement is any writing, painting, drawing or marking implement which is operated with writing liquid, in particular liquid ink. Examples which may be mentioned are marker pens provided with a colored marking liquid or ball-point ink pens, which are obtainable in many colors.

In order to prevent the durable formation of an ink film on the inner surface of the liquid reservoir, the inner surface of the liquid reservoir 16 is, in accordance with the invention, coated, at least partly, for example in the transparent region of the reservoir. In order to achieve the desired effect, the coating must have various properties. Firstly, it must itself likewise be transparent, so that the ability to be looked into is retained. Furthermore, the coating must consist of a material which is neither dissolved by the writing liquid nor impairs the writing liquid in any way or changes the color of the writing liquid. In addition, the material must be capable of application in a thin layer and should preferably also be suitable for emulsifier-containing water-based inks.

It has been found that all these requirements are met if the coating consists of silicone rubber. In accordance with the invention, therefore, the liquid reservoir is provided on the inside with a layer of silicone rubber. To this end, the silicone rubber is applied in a thin layer on the inside at least to the transparent region of the liquid reservoir. Preferably, the entire inside of the liquid reservoir is provided with a layer of silicone rubber. The silicone rubber should only be provided in a thin layer. If the rubber layer is too thick, detachment of the coating takes place, so that it no longer does its job and can change the writing liquid disadvantageously. In addition, it has been found that if the coating is too thick, the writing liquid migrates between the wall of the tank and the coating material, causing the transparency to be lost. The thickness of the silicone rubber layer is therefore preferably from 2 to 100 $\mu$m. In this range, the disadvantageous effects are not observed. The layer thickness is particularly preferably from 10 to 50 $\mu$m The silicone rubber applied is particularly preferably silicone rubber obtained by addition polymerization or condensation polymerization.

The coating of the liquid reservoir can take place in a manner known per se by applying silicone rubber to the inner wall. To this end, the silicone rubber can be dispersed in a suitable paraffin hydrocarbon or isoparaffin or liquefied and then applied to the wall in a manner known per se. The silicone rubber is preferably generated in situ on the inner wall of the liquid reservoir.

To this end, for example, at least 2 crosslinkable silicone components are brought into contact and allowed to react in the presence of a catalyst. Suitable silicone components for the addition polymerization here are mixtures of siloxane chains, where in the first component the chains have terminal or side-chain unsaturated alkyl groups, in particular ethene groups, and in the other component the groups have terminal or internal hydrogen atoms. In the presence of a catalyst, the unsaturated alkyl group then reacts with the silicon atom to which the hydrogen atom is bonded, with formation of a C—Si bond, causing the chains to crosslink. In condensation polymerization, siloxane chains carrying OH chains are reacted with chains carrying alkoxy groups in the presence of a catalyst, resulting in crosslinking via Si—O—Si bonds.

In a preferred embodiment, the coating is generated on the inner wall of the reservoir by mixing the two crosslinkable silicone components, adding catalyst, and then spraying the mixture onto the inner wall of the liquid container by means of an annular nozzle. The amount of catalyst here is selected so that the application time is sufficiently long that the material does not polymerize in the annular nozzle and block the nozzle. The corresponding proportions of the components are known per se to the person skilled in the art and can easily be determined for each specific compound by routine experiments.

In another embodiment, the mixture of silicone components and catalyst is applied to the inside in the front region of the liquid reservoir and then distributed over the inner surface by centrifugation. Since the medium to be applied has high viscosity, it is not always possible for a uniformly thick film to be achieved by this method. In some cases, a non-coherent film is also formed.

In a further embodiment, the liquid reservoir can be coated by blowing the individual components into the reservoir one after the other as aerosols and allowing them to react to completion on the wall. However, this embodiment is only suitable if complete coating is intended, since the spraying causes the components to reach all regions. Therefore, if the inlet aperture is to remain free from the film, another embodiment must be selected. In this embodiment, the mixing ratios should be observed very precisely in order to achieve curing and in order to obtain an insoluble film. This method therefore requires a high degree of precision of the application nozzles and very reliable metering.

The following embodiment has proven particularly advantageous. Here, the individual components are dissolved in a solvent, preferably a volatile organic solvent, and the suitable amount of reaction catalyst is added. This solution is then introduced into the liquid reservoir to the desired level and then immediately sucked out again. As soon as the residues of the solvent have evaporated, a uniform polymer film remains on the wall. By suitable metering of the catalyst, the reaction time and thus the possible use time can be adjusted. By means of this method, it is possible to apply a film of the desired thickness uniformly in the regions of the liquid reservoir which are provided for this purpose. A solvent which has proven particularly suitable is petroleum ether. Other solvents which dissolve the silicone components are, however, likewise suitable. Unsuitable solvents are those which partially dissolve the plastic of the liquid reservoir.

The invention provides a writing implement whose liquid reservoir is coated in such a way that adhesion of the writing liquid to the surface is prevented or at least greatly minimized and which is at the same time inert toward the writing liquid. The consequence of this is that the writing liquid beads off the coated part of the wall of the liquid reservoir at all times, and the fill level is thus readily visible at all times.

What is claimed is:

1. A writing implement comprising a dispensing device for writing liquid at the front end of the implement and a liquid reservoir for holding the writing liquid which is at least partly transparent at the rear end of the instrument, the improvement comprising the liquid reservoir is coated on the inside surface, at least in part, with a silicone rubber layer which allows the writing liquid to run off the inside surface.

2. A writing implement as claimed in claim 1, wherein the writing liquid is a solvent-based ink.

3. A writing implement as claimed in claim 1, wherein the liquid reservoir is coated with a silicone rubber layer having a thickness of from 2 to 100 $\mu$m.

4. A writing implement as claimed in claim 3, wherein the liquid reservoir is coated with a silicone rubber layer having a thickness of from 10 to 50 $\mu$m.

5. A writing implement as claimed in claim 1, wherein the silicone rubber layer is a rubber layer formed in situ by polymerization.

6. A writing implement as claimed in claim 1, wherein the silicone rubber layer is formed by mixing two crosslinkable silicone components with a small amount of catalyst to form a mixture, distributing the mixture over the inside surface, and reacting the components in situ with the catalyst to form the layer.

7. A writing implement as claimed in claim 1, wherein the silicone rubber layer is formed by dissolving two crosslinkable silicone components in a suitable solvent, adding a suitable amount of reaction catalyst to form a solution, introducing the solution into the liquid reservoir, and sucking out the solution.

* * * * *